United States Patent [19]

Alterman

[11] 4,052,860

[45] Oct. 11, 1977

[54] CONSTRUCTION OF UNDERGROUND TUNNELS AND ROCK CHAMBERS

[75] Inventor: Israel Alterman, Savyon, Israel

[73] Assignee: Environmental Engineering Dr. Ing. Alterman Ltd., Savyon, Israel

[21] Appl. No.: 631,445

[22] Filed: Nov. 13, 1975

[30] Foreign Application Priority Data

Dec. 9, 1974 Israel ..... 46208

[51] Int. Cl.[2] ..... E21D 20/00

[52] U.S. Cl. ..... 61/45 B; 61/63; 299/11

[58] Field of Search ..... 61/45 B, 45 R, 42, 63, 61/84; 299/11

[56] References Cited

U.S. PATENT DOCUMENTS

| | | | |
|---|---|---|---|
| 3,695,045 | 10/1972 | Williams | 61/45 B |
| 3,877,235 | 4/1975 | Hill | 61/45 B |
| 3,893,303 | 7/1975 | Rotter | 299/11 X |
| 3,940,941 | 2/1976 | Libert et al. | 61/45 B |

FOREIGN PATENT DOCUMENTS

| | | | |
|---|---|---|---|
| 1,200,795 | 12/1959 | France | 299/11 |
| 1,304,298 | 8/1962 | France | 61/45 B |
| 1,966,497 | 4/1973 | Germany | 61/45 B |
| 40,335 | 11/1957 | Poland | 61/45 B |
| 142,080 | 9/1952 | Sweden | 61/45 B |

*Primary Examiner*—Dennis L. Taylor
*Attorney, Agent, or Firm*—Bacon & Thomas

[57] ABSTRACT

Reinforcing the rock walls of a cavity comprises drilling long holes into the rock at predetermined distances and grouping and to a predetermined depth, inserting a bar-shaped tension member of high tensile strength into each of these holes and fixing their end of each member in the inner end of the respective hole. The tension members are subsequently elongated by biasing their outer ends against the cavity surface by known tension means such as screw nuts or wedges, thereby compressing the rock and preventing cracks from developing. In order to convert such cavities into tight containers, an impervious pliable sheet material is laid close to the cavity wall and held there by fastening it to the protruding ends of the tension members.

9 Claims, 4 Drawing Figures

CONSTRUCTION OF UNDERGROUND TUNNELS AND ROCK CHAMBERS

BACKGROUND OF THE INVENTION

The invention relates to the reinforcement of the walls of underground tunnels and rock chambers by prestressing. It furthermore relates to a method of making the prestressed cavity walls impermeable against seepage of liquids.

In tunnelling and in excavating underground rock chambers one of the main problems is the displacement of the tunnel walls by the enormous weight of the overlying rock and soil masses, often making bracing and lining imperative in order to prevent collapse of the excavation. This is not always necessary with hard rock where large sections of a tunnel may be self-supporting; however in deep-lying sections the very high pressure reached, causes plastic flow in the rock with subsequent displacement of the cavity walls; to counteract this pressure and to prevent penetration of water, internal lining — made of concrete in modern structures — is applied to the walls. In soft rock, such as lime stone, tunnelling generally requires a permanent lining, especially where fissures can be expected and the overlying weight is large.

Theoretically, a cylindrical or spherical cavity within a rock mass would not collapse under the weight of the mountain, since equally distributed stresses should appear according to simplified calculations based on the classical theory of elasticity. In practice, however, the forces acting along the circumference are not uniformly distributed, but may appear as alternate compression and tension zones in different portions of the wall. Rock can withstand considerable compression forces, unless the stress exceeds the plastic flow limit, but its tensile strength is low, so that tension or shearing stresses may cause cracks and fissures and eventual caving-in of the walls.

Lining, therefore, becomes necessary in tension zones; however since these cannot be clearly defined and detected during excavation, the whole tunnel length is generally provided with lining which incidentally controls water seepage. The same rules apply to the construction of underground chambers and tanks, be they of spherical, ellipsoidal or other vaulted shape.

In certain cases, where only a clearly defined portion of the tunnel or cavity shows fissures or signs of collapse, it is customary to insert and anchor long bolts into holes drilled into the rock, with the aim to strengthen the affected portion and to hold the rock in place. In the plurality of cases, however, because of the unreliabitity of a partly reinforcement only, complete lining of the area is greatly preferred.

Lining of any rock cavity is expensive per se, whether it is in the form of steel casings, prefabricated concrete sections or cast-in-situ concrete. It causes additional expenses by making necessary the excavation of the volume of rock taken subsequently by the lining and, in tunnelling, slows down the excavation progress by clogging up the narrow tunnel section owing to the large amounts of building material to be transported.

In view of these drawbacks it has been made the object of the present invention to dispense with the lining of tunnels or other excavations altogether and to replace it by converting the rock around the cavity into a self-supporting and load-bearing structure, by prestressing it to a degree beyond the largest tension and shearing stresses apt to occur in the respective portion of the cavity wall.

SUMMARY OF THE INVENTION

In accordance with the invention the conversion of the walls of a rock cavity into a self-supporting, load-bearing layer by prestressing comprises first, making a plurality of long bores in the wall section to be prestressed, angularly disposed or perpendicular in relation to the wall surface, in a predetermined grouping and spacing and to a predetermined depth; secondly, inserting into each bore a bar-like tension member of high tensile strength and rigidly connecting a predetermined length thereof adjoining its inner end to the bore end portion by known means such as e.g., grouting, leaving the remaining part unattached to the bore, while its outer end protrudes out of the bore into the cavity, thirdly, forcefully elongating the tension member by biasing its protruding end against the rock surface by known tension means and continuing the elongation operation until the resulting compression of the rock portion adjacent the bore and the tension member therein is at least commensurate with the largest tensile stress liable to appear in this region.

A preferred grouping of the bores and tensioning members suitable for prestressing a large rock volume around a cylindrical tunnel or cavity by means of a relatively small number of tension members comprises arranging a group of bores in the shape of a "one-sheet hyperboloid" around and coaxial with the said cavity by drilling the bores into the rock from substantially equidistant points on a first circle or a circumferential curve around the cavity wall at substantially the same incident angle between the bore and the cavity surface, each bore being drilled to substantially the same depth, with the result that all bores end on a co-axial second circle or circumferential curve of greater diameter than the cavity diameter which second circle or curve is longitudinally displaced from the first circle or curve. Tension members are subsequently inserted into all bores, fastened and elongated in the aforedescribed manner.

A desired length of the tunnel or cavity is suitably reinforced by adjacent groups of bores and tension members arranged in similar and co-axial hyperboloids. The number of bores, their length and incident angle are variables of the rock strength, the weight of the overlying rock and other factors.

In a preferred embodiment of the invention a loose skin or membrane of a thin, liquid-impervious sheet material is fastened adjoining the cavity wall by attaching it to the protruding ends of the tension members. This membrane is advantageously formed from a plurality of single sheets by watertight seams to cover the entire cavity surface, thus making the latter suitable for the storage of liquids or grain.

Figure 1:
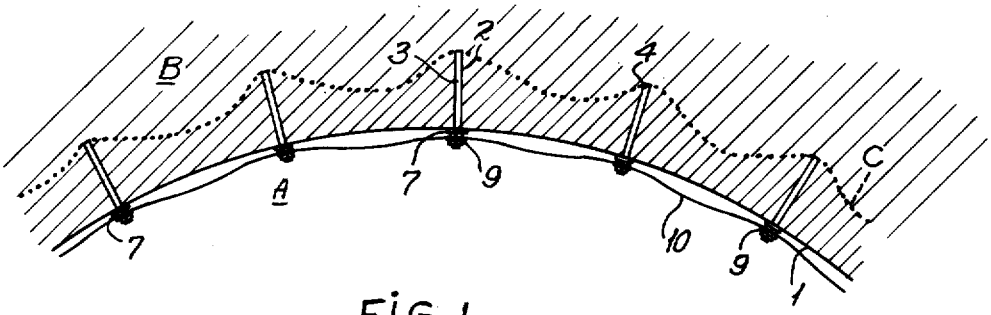
FIG. 1 is a cross section through a portion of an underground storage tank.
Figure 2:
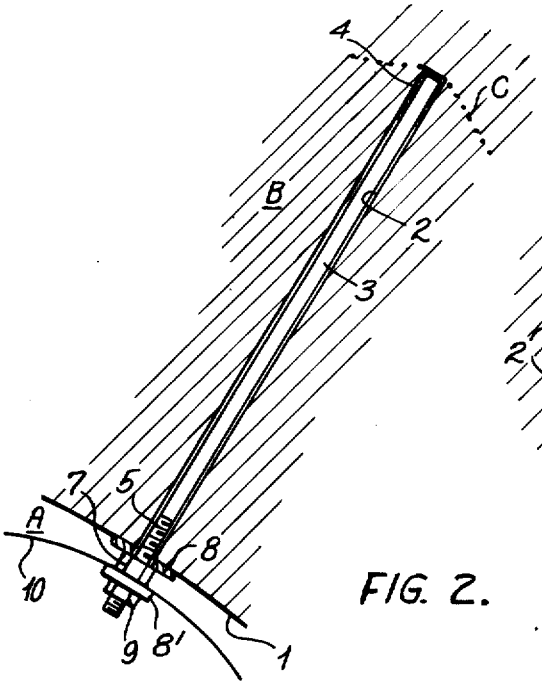
FIG. 2 shows a bore and a tension member on a larger scale.

DESCRIPTION OF THE PREFERRED EMBODIMENT:

With reference to FIG. 1 of the drawing a rock cavity A is shown to have been excavated in rock B, the vaulted ceiling contours being denoted by a line 1. A number of bore holes 2 have been drilled into the rock to a depth and at distances dependent on the tension forces to be expected and to be counteracted by prestressing. One of these bores 2 is shown on an enlarged scale in FIG. 2, with a tension bar 3 fully inserted. It is fastened therein at the extreme end by grouting 4 which is applied by first inserting a plastic bag containing the grouting mixture and then bursting it open while inserting the bar. This procedure is known to the art, a suitable mixture containing four parts of sand and two parts of cement to one part of epoxy resin. The bar protrudes out of the bore with its outer end 5 which is screw-threaded (5) and has a large washer 8 and a nut 7 mounted thereon.

After setting of the grouting the end of the bar 3 is rigidly fastened in the bore; the bar is now elongated and tensioned by tighteneing the nut 7 against the rock surface — via the washer 8 — and the rock volume along the bar is compressed correspondingly. With a view to obtain the correct stresses, tightening of the nut is advantageously done by means of a prestressing jack. The compressed portion of the rock is shown to extend as far as the dotted line C, while the rock mass beyond this line would be practically unaffected.

Figure 4:
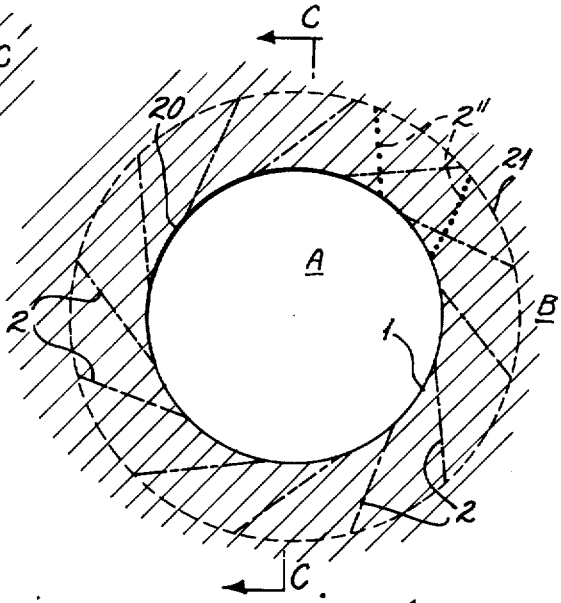
FIG. 4 is a cross section through the cylindrical cavity and the hyperboloidal grouping of reinforcement as illustrated in FIG. 3.
Figure 3:
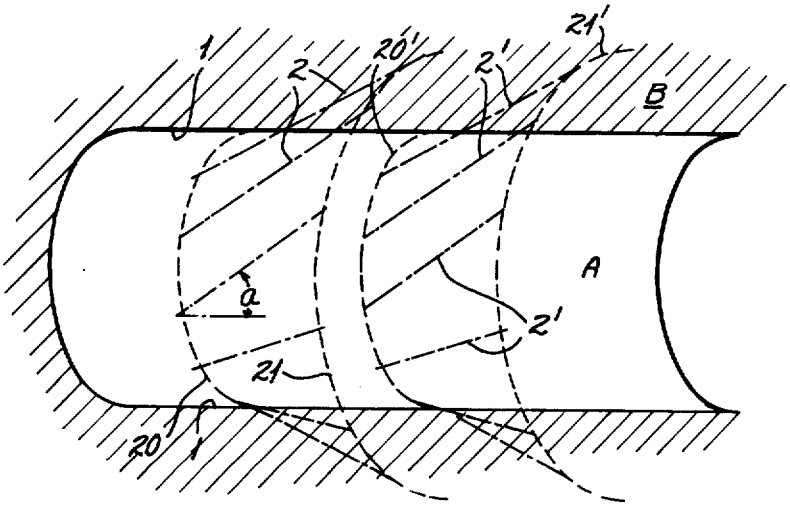
FIG. 3 is a diagrammatic, isometric view of the rear bisection of a cylindrical cavity, along C—C of FIG. 4, with reinforcing members arranged in the shape of a one-sheet hyperboloid.

Referring now to FIGS. 3 and 4 of the drawings, a cavity or tunnel A having a contour 1 is reinforced by tension members which are inserted into bores 2 drilled into the rock B to equal length so as to form a "one-sheet hyperboloid". The hyperboloid is formed by the generatrices of the bore centre lines 2 which start at equidistant points on a first circle 20 or other circumferential curve and enter the rock at an incident angle *a* with the center line lying in a plane not coinciding with the cavity axis. All inner ends of the bores lie on a second, larger circle or curve 21 which is parallel to and remote from the first circle or curve. A second hyperboloid consisting of bores 2' extending between a first circle or curve 20' and a second circle or curve 21', is shown to the right of the first hyperboloid, and additional groups of bores and tension members may be added in both directions along the cavity, in accordance with rock and load conditions.

FIG. 4 shows — in dotted lines — two out of a group of bores 2" which are drilled into the rock in an opposite sense of direction to that of the bores 2. This may become necessary wherever additional reinforcement is required. It is obvious that the sense of direction as shown in FIG. 3 is completely arbitrary, and that any angle or direction may be chosen according to requirements and convenience. In certain cases the bores may even lie in radial planes passing through the cavity center, thus forming a straight cone frustum.

The method described-up to this point is satisfactory in the construction of tunnels, underground shelters or other cavities, especially in dry climates where the subterranean water level is generally low. However, in all cases where it is desired to build subterranean grainstores or oil, gas or water tanks it is important to line the walls with a skin or membrane of an impermeable material. The application of such membrane in accordance with the invention is as follows:

After the walls of a spherical, ellipsoidal or otherwise vaulted cavity have been prestressed by the aforedescribed method, thin metal sheets, flexible plastics sheets or sheets of any other impermeable material 10 are attached to the threaded ends of the tension bars through corresponding holes in the sheets and tightly clamped by annular gaskets 8' against the surface of the nuts 7 by outer nuts 9. The sheets are not in close contact with the rock walls; to the contrary, it is desired that they are freely movable, as will be explained further on. Using plastic sheeting makes it possible to prepare a large area of the membrane above ground before attaching it to the wall; for instance in the case of a sperical cavity, two hemispherical membranes may be prepared and inserted through an entrance opening, spread and attached to the bars. The two halves are subsequently jointed along their edges by pressure welding or any other means known to the art.

The metal skins will be assembled from separte sheets which can be readily inserted into the cavity; they are perforated in situ for attachment to the bar ends and subsequently jointed along their edges by welding, soldering or the like.

It is understood that the material will be chosen in accordance with its resistance against chemical attack of the material to be stored; an oil tank will preferably be lined by plastic sheeting not affected by oil or a thin metal layer protected against corrosion.

The main advantage of the freely movable membrane is that it permits gas evaporated by temperature increase from oil stored in a sealed tank, to expand freely, since it lets the tank volume increase by giving way. During cooling the gas will contract and be condensed, and the membrane will detach itself from the rock surface, with the desirable result that no change in pressure will occur and that gas otherwise lost to the atmosphere is being saved.

The method, as well as the elements utilized in its embodiment, may undergo various alterations and modifications within the spirit of the invention.

Instead of solid steel bars, tubular members or steel wire ropes may be used, with means for attachment and tensioning provided at their respective ends.

A further method of fastening the inner bar end within the bore is by primarily loosely threading an expandable, slotted plug or wedge of known design onto the threaded end of the bar and screwing the latter into the plug after insertion the bore. The entering bar displaces a ball or a tapered body which causes the slotted parts to expand against the bore walls and to prevent withdrawel by external forces.

The tightening of the tension bar may be obtained by driving a wedge between the rock wall and a projection on the bar. Other means of attachment may be used for fastening the membrane to the bar ends.

I claim:

1. A method of converting the walls of a rock cavity into a load-bearing structure by prestressing comprising the steps of:

making a plurality of long bores in the walls along the entire cavity to be prestressed, said bores being angularly disposed in relation to the wall surface, and said bores being arranged in the shape of a one-sheet hyperboloid around and coaxial with said cavity, inserting into each bore a tension member of high tensile strength and rigidly connecting a predetermined length thereof adjoining its inner end to the bore end portion, leaving a remaining part of said tension member unattached to the bore and causing the outer end of said tension member to protrude out of the bore into the cavity, forcefully elongating the tension member by biasing the protruding end thereof against the rock surface, said elongation step being adapted to provide a resulting compression of the rock pattern adjacent the bore and the tension member therein at least commensurate with the largest tensile stress liable to appear in this region.

2. A method as defined in claim 1, wherein said step of making said plurality of long bores further comprises the step of drilling the bores into the rock from substantially equidistant points on a first circumferential curve around the cavity wall at substantially the same incident angle between the bore and the cavity surface, each bore being drilled to substantially the same depth, whereby said bores end on a coaxial second curve of greater diameter than the cavity diameter, said second curve being longitudinally displaced from the first curve.

3. A method of reinforcing a cavity as recited in claim 2 further comprising the step of arranging adjacent groups of bores and tension members in similar and co-axial hyperboloids.

4. A method as claimed in claim 1 wherein said step of inserting and connecting further comprises fastening the ends of the tension members in the bores by grouting, using a mixture of an epoxy resin, sand and cement in the ratio of 1 : 4 : 2.

5. A method as claimed in claim 1 further comprising the step of attaching a membrane of a thin, liquid-impervious sheet material to the protruding ends of the tension members and maintaining said membrane in a spaced apart relationship with the walls of the cavity, whereby said membrane serves as lining for a cavity to be used for the storage of granular gaseous or liquid materials and the space between said member and said cavity provides room for expansion of said membrane responsive to changes in volume of the materials being stored.

6. A method of reinforcing cavities within a rock formation comprising the steps of making a plurality of long bores in the rock volume, said bores being angularly disposed in relation to the cavity's surface, pl arranging a group of bores in the shape of a "one-sheet hyperboloid" around and coaxial with said cavity, drilling the bores into the rock from substantially equidistant points on a first circle around the cavity at substantially the same incident angle between the bore and the cavity surface, each bore being drilled to substantially the same depth, inserting into each bore a tension member of high tensile strength and rigidly connecting a predetermined length thereof adjoining its inner end to the bore end portion, leaving a remaining part of said tension member unattached to the bore and causing the outer end of said tension member to protrude out of the bore into the cavity, forcefully elongating the tension member by biasing the protruding end thereof against the rock surface, said elongation step being adapted to provide a resulting compression of the rock portion adjacent the bore and the tension member therein at least commensurate with the largest tensile stress liable to appear in this region, whereby said bores end on a coaxial second circle of greater diameter than the cavity diameter, said second circle being longitudinally displaced from the first circle.

7. Apparatus for prestressing walls of a rock cavity comprising:

a. an elongated tension member having two ends, adapted for insertion in a bore provided in said wall of said rock cavity;

b. means for attaching a length of said tension member, beginning at one end thereof, to a portion of said bore;

c. said attaching means comprising a bonding mixture including an epoxy resin, sand and cement in the ratios of 1:4:2, d. means for elongating said tension member by biasing a second end thereof against said rock surface, and e. cooperating means for lining said cavity, said cooperating lining means comprising a thin, fluid-impervious material primarily having a spaced apart relationship with the cavity, said cooperating lining means being attached to said cavity at several points whereby said cavity is usable for storing granular, gaseous, or liquid materials.

8. A method as recited in claim 5 wherein said step of inserting and connecting further comprises the steps of:

a. inserting a container containing said grouting mixture therein, b. bursting said container open while inserting said tension member into said bore.

9. A method of reinforcing an entire cavity within a rock formation by using tensioned anchor bolts comprising the step of arranging said anchor bolts around the periphery of the entire cavity to be reinforced in a predetermined configuration of a plurality of coaxially arranged one-sheet hyperboloids, said arranging step further comprising the steps of:

drilling a plurality of long bores into the rock, from substantially equidistant points on a first circumferential curve around the cavity wall, at substantially the same incident angle between the bore and the cavity wall, and to substantially the same depth, the bores defining plural shapes of one-sheet hyperboloids around and coaxial with said cavity, inserting into each bore a tension member of high tensile strength, and forcefully elongating each tension member by biasing a protruding end thereof against the rock, thereby providing a resulting compression of the rock portion adjacent said bores.

* * * * *